United States Patent [19]

Frost

[11] Patent Number: 5,069,454

[45] Date of Patent: Dec. 3, 1991

[54] HAND ACCESSORY

[76] Inventor: John H. Frost, 781 Kohler St., Los Angeles, Calif. 90021

[21] Appl. No.: 611,616

[22] Filed: Nov. 13, 1990

Related U.S. Application Data

[63] Continuation-in-part of Ser. No. 538,454, Jun. 15, 1990, abandoned.

[51] Int. Cl.[5] ..... A63B 57/00

[52] U.S. Cl. ..... 273/165; 273/166; 2/20

[58] Field of Search ..... 273/25, 26 R, 26 C, 273/81 D, 165, 166; 2/16, 17, 18, 19, 20, 21

[56] References Cited

U.S. PATENT DOCUMENTS 1,200,580 10/1916 Brenner ..... 2/20

4,461,043 7/1984 Lomedico ..... 2/21

FOREIGN PATENT DOCUMENTS 322512 12/1929 United Kingdom ..... 273/165

*Primary Examiner*—William H. Grieb

*Attorney, Agent, or Firm*—Jack C. Munro

[57] ABSTRACT

A hand accessory contoured to fit into the webbed portion of the hand between the base of the thumb and the base of the forefinger, to overlie that area and to extend down into the palm to enable the handle of a piece of sport equipment or of a tool to be gripped snugly by the hand and to be swung to impact with a ball or other object without substantial movement of the web area of the hand before or at impact relative to the remainder of the hand. This enables full force to be transmitted from the hand to the handle. The hand accessory may be located in a glove mounted directly onto a handle or connected to the hand by releasable straps or other similar attachment.

12 Claims, 2 Drawing Sheets

HAND ACCESSORY

CONTINUING APPLICATION

This application is a continuation-in-part of U.S. patent application Ser. No. 07/538,454, filed 6/15/90, entitled "HAND ACCESSORY", now abandoned.

BACKGROUND OF THE INVENTION

1. Field of the Invention

The present invention generally relates to hand accessories and more particularly to those useful for improving power transmission between the hand and the handle of an implement, such as a piece of sports equipment or a tool.

2. Prior Art

When gripping and swinging a baseball bat, tennis racquet, hockey stick or hammer, there is a space between the handle and the base of the thumb and the forefinger, filled with a loose compressible web of skin. This area is a low density space which contains no bone or muscle. When the player swings the bat, racquet or stick or strikes the ball or puck, the force of impact recoils the bat handle, racquet handle or stick handle back into the web, compressing it. This absorbs and dissipates energy otherwise transmissible to the ball or puck, thus causing a weaker than optimal shot. No matter how tightly one grips the handle, this space remains soft like a sponge. Even before the ball or puck is hit, at the start of the swing, the hand or hands holding the handle move forward but the inertia of the bat causes it to move back, relatively speaking, into the web, compressing it. The handle then loses speed and must eventually catch up with the front of the hands. Both timing and power, as well as bat, racket or stick speed are lost, with the final result a less than optimal or full-force shot. U.S. Pat. No. 4,461,043 seeks to provide a cushion in the hand web but does not improve speed or power transmission between the hand and handle of a baseball bat.

There remains a need for a simple device capable of increasing bat, racquet or hockey stick speed and of improving force transmission between the hand and handle of the bat, racquet or hockey stick for improved power hitting of a ball or puck. The device should be capable of being made in a variety of sizes and shapes and forms, and be capable of protecting the hand against injury. It should be utilizable with barbell weight lifting and other sports, and with various tools, such as hammers, etc. It also should reduce strain on the fingers.

SUMMARY OF THE INVENTION

The hand accessory comprises a contoured shaped, solid plug which has a generally inverted L-shape in side elevation with a horizontal top portion extending over the top of the web of the hand between the base of the thumb and the base of the forefinger. A vertical portion is integral with the horizontal portion and descends therefrom down into the palm of the hand. The front of the plug is curved to fit the curve of the handle of the bat, hockey stick, racquet or the like. It may be resilient and grooved, notched or serrated to allow it to adapt to various handle contours, such as hammers and other hand held hools. The rear of the plug may be resilient and the front of the plug relatively inflexible. A vertical slot may be present in the front of the plug to hold a removable reinforcing metal insert or the like.

Because the plug fills the web space, rather than protruding out in a bulky fashion, it may be worn unnoticed under a batting glove (permanently attached or removable), which, in turn, may be worn under a fielding glove with no interference in performance.

Also, the plug may removably fit into a pocket of a batting glove, hockey glove, etc., or be attached to the front of the web area thereof. Alternatively, it can bear elastic straps and be attachable around the hand or wrist of the user without use of a glove. The plug can also be connected releasably or permanently to the handle of the bat, racquet, stick, etc., as by adhesive, spring clip or the like. The accessory can be used with hand tools, barbells and all types of handle-bearing sport equipment. It could also be built permanently into any handle.

To increase leverage, the design of the plug could include a vertical portion having an upper end thereof extending rearwardly to thereby create a fulcrum to enhance the power capable of being transmitted from the hand to the tool.

DETAILED DESCRIPTION

FIGS. 1–4

Figure 1:
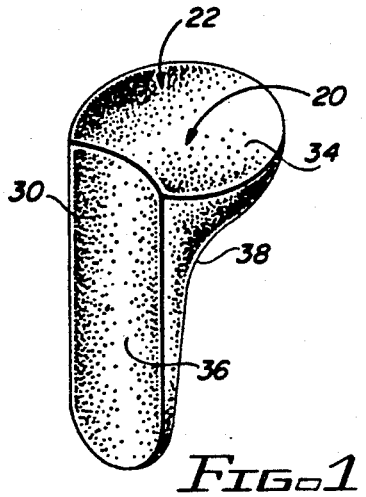
FIG. 1 is a schematic side perspective view of a first preferred embodiment of the hand accessory of the present invention.

Now referring more paticularly to FIGS. 1–4 of the drawings, a first preferred embodiment of the hand accessory of the present invention is schematically depicted therein. Thus, hand accessory 20 is shown, which comprises a solid plug 22 having a contoured shape to fit snugly into the web 24 of the hand 25 (FIG. 4) between the base of the thumb 26 and the base of the forefinger 28, with the front 30 of plug 22 having a curvature to match that of the handle 32 of a bat, racquet, hockey stick like (not shown).

Plug 22 is generally inverted L-shaped in side elevation, with an upper generally horizontal portion 34 and an integral descending vertical portion 36. The rear 38 of plug 22 is curved to fit over and around the front of web 24 and down into the palm cf hand 25, abutting it.

Thus, horizontal portion 34 tapers or thins rearwardly, while vertical portion 36 tapers or thins downwardly.

Figure 2:
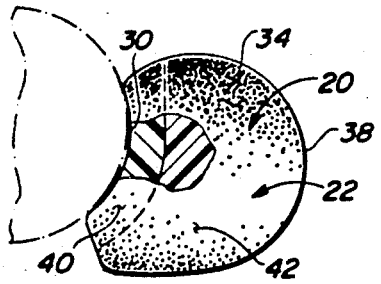
FIG. 2 is a schematic top plan view, partly broken away, of the accessory of FIG. 1 abutting a baseball bat handle.
Figure 3:
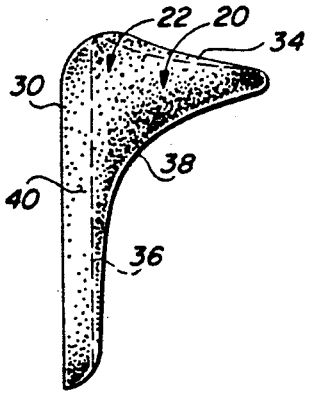
FIG. 3 is a schematic side elevation of the accessory of FIG. 1.
Figure 4:
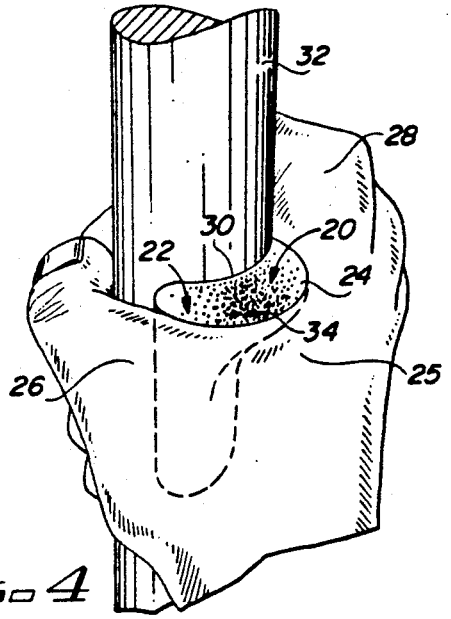
FIG. 4 is a schematic rear perspective view of the accessory of FIG. 1, shown being used around a baseball bat handle which is gripped by a player.

As shown in FIG. 2, plug 22 may be constructed of a relatively inflexible hard portion 40 of plastic, metal, wood, or the like near to and forming front 30, and a relatively flexible portion 42 of rubber, plastic, or the like near to and forming rear 38. It will be understood that, if desired, plug 22 could be fabricated of all hard materials, such as metal, hard plastic, etc., or of a somewhat flexible material such as soft rubber, soft plastic, or the like.

It will be understood that plug 22 can be of various sizes and shapes. It can be fashioned to fit a particular hand web and palm perfectly when the hand is wrapped around the handle of an implement such as a bat, racquet, hockey stick or a tool such as a hammer, shears, pliers, etc.

Plug 22 can be disposed within the pocket of a glove (not shown) to be worn on the hand, or glued or otherwise secured to the front of the web portion thereof. Alternatively, plug 22 can be clipped, glued or otherwise attached permanently releasably to the handle 32. Plug 22, when used, fills the web 24 of hand 25 and contacts the palm of that hand, curving to fit handle 32 and enabling handle 32 to be swung without rocking back and forth in compressed web 24, thus facilitating a more compact, more rapid and more powerful swing with handle 32.

Moreover, upon contact of the head of the bat, racquet or stick to which handle 32 is attached and forms part thereof with a baseball or the like, full force is transmitted to such ball to drive if farther, because web 24 does not recoil, or move backward in hand 25 and absorb some of such force, but is relatively immobile relative to hand 25. The net result is a more powerful hit or shot.

The same situation applies when handle 32 is attached to the operating head of a tool such as a hammer. A blow delivered thereby is more forceful. Inasmuch as the parts of hand 25 in the force-transmitting area hold the relatively resilient but compressed portion 42 of plug 32, the shock felt by the hand 25 upon striking the ball, puck, etc., is uniformly distributed throughout hand 25 and hand 25 is thereby effectively protected against injury.

Accordingly, hand accessory 20 not only protects hand 25 but assures maximum speed of handle 32 and maximum delivery of force from hand 25 to the object being hit by means of handle 32 for maximum results.

FIGS. 5 & 6

Figure 5:
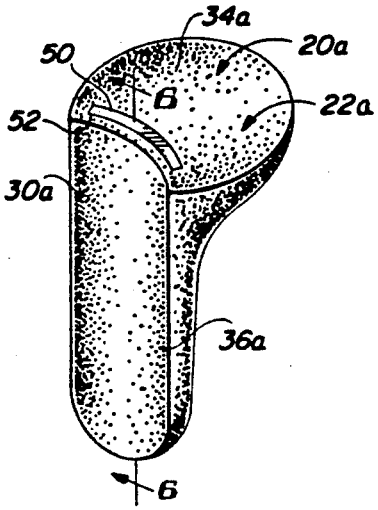
FIG. 5 is a schematic side perspective view of a second preferred embodiment of the hand accessory of the present invention.
Figure 6:
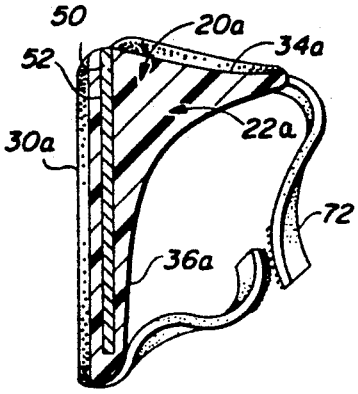
FIG. 6 is a schematic section taken along the section line 6—6 of FIG. 5.

A second preferred embodiment of the hand accessory of the present invention is schematically depicted in FIGS. 5 and 6. Thus, hand accessory **20*a* is shown. Components thereof similar to those of accessory 20 bear the numerals but are succeeded by the letter "a". Accessory 20*a* is substantially identical to accessory 20**, except as follows:

a) plug **22*a* is formed of a single uniform, sightly flexible material, such as plastic, or rubber; and, b) the front portion 30*a* is stiffened and strengthened through the use of a curved steel plate 50 releasably disposed in a vertical slot 52** therein.

c) an elastic strap 72 is secured to plug **22*a***.

Plug **22*a* has substantially the advantages of plug 22**.

FIG. 7

Figure 7:
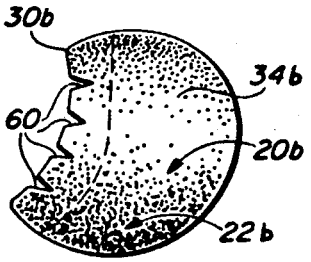
FIG. 7 is a schematic top plan view of a third preferred embodiment of the hand accessory of the present invention.

A third preferred embodiment of the hand accessory of the present invention is schematically depicted in FIG. 7. Thus, hand accessory **20*b* is shown. Components thereof similar to those of accessory 20 or 20*a*** bear the same numerals, but are succeeded by the letter "b".

Accessory **20*b* is substantially identical to accessory 20*a*** except as follows:

a) accessory **20*b* has no steel plate or slot; and, b) the resiliency and confirmability of front 30*b* to various handles is increased by providing front 30*b* with a plurality of spaced vertical notches 60**.

Plug **22*b* has substantially the advantages of plugs 22 and 22*a***.

Figure 8:
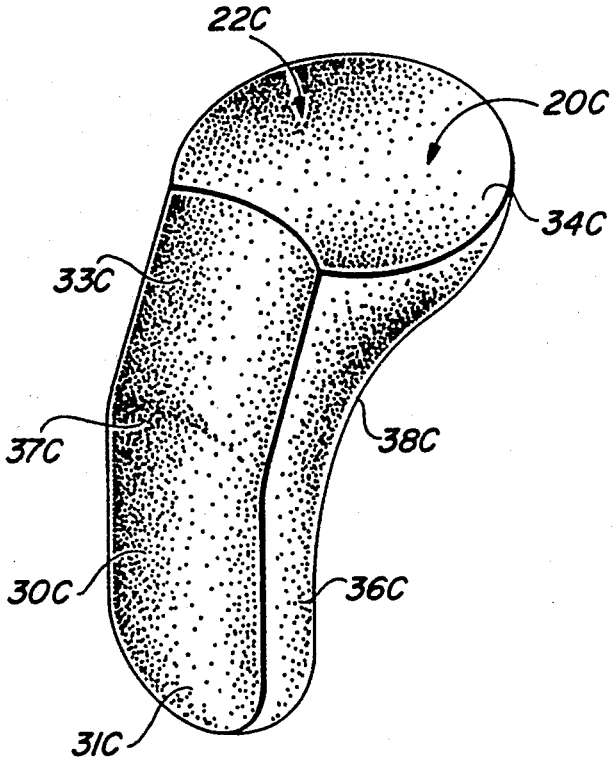
FIG. 8 is a schematic side perspective view of a fourth preferred embodiment of the hand accessory of the present invention.
Figure 9:
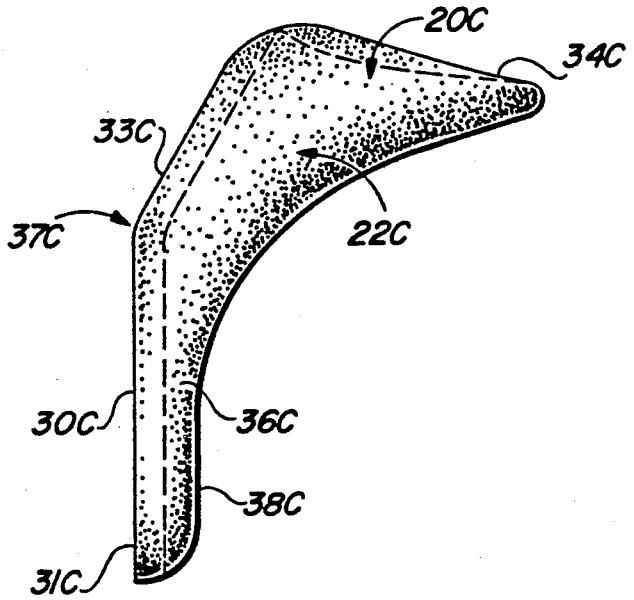
FIG. 9 is a schematic side elevation of the accessory of FIG. 8.

FIGS. 8 and 9

A fourth preferred embodiment of the hand accessory of the present invention is schematically depicted in FIGS. 8 and 9. Thus, hand accessory **20*c*** is shown.

Components thereof similar to those of accessory 20, **20*a*, or 20*b*** bear the same numerals, but are succeeded by the letter "c".

Accessory **20*c* is substantially identical to accessory 20 except that front 30*c* does not extend vertically upwards in substantially a straight line. Instead, the front 30*c* of plug 22*c* has lower portion 31*c* and an upper portion 33*c* which lie at an angle with respect to one another. This design essentially provides a fulcrum at 37*c* which lies below the top 34*c*, as opposed to the fulcrum of plug 22 of FIG. 1, which lies at the intersection of top 22 and front 30** thereof.

The design of plug **22*c* moves the fulcrum of the tool such as bat 32, closer to the base of the hand 26**, resulting in a greater force being transmitted by the hand to the bat as it moves through its operative positions, resulting in a more efficient transfer of power.

It can be appreciated that a sharp fulcrum point **37*c* is not absolutely necessary. A more rounded vertical front portion 30*c* can be provided with a slightly round fulcrum at 37*c*, without departing from the scope of the present invention. Plug 22*c* has substantially all the other advantages of plugs 22, 22*a* and 22*b***.

Various modifications, changes, alterations and additions can be made in the hand accessory of the present invention, its components and parameters. All such modifications, changes, alterations and additions as are within the scope of the appended claims form part of the present invention.

What is claimed is:

1. A hand accessory to be used in conjunction with the handle of an implement, said accessory comprising a solid plug contoured to extend over, fit into and fill the webbed portion of the hand between the base of the thumb and the base of the forefinger and to extend down into the palm of the hand, said plug being generally inverted L-shaped in side elevation with an upper generally horizontal portion extending over the webbed portion of the hand and having an outer surface which is curved to fit the contour of the handle of the implement when held in the hand, said generally horizontal portion tapering down in thickness from said front to a curved rear, said horizontal front being integral with a vertical portion descending therefrom, said vertical portion having a curved front to fit the contour of said handle and a rear adapted to contact the palm of the hand, said plug being adapted to transmit full power directly between the hand and handle without substantial relative movement of the web between the thumb and forefinger of the hand.

2. The hand accessory of claim 1 wherein said plug is adapted to be secured to said handle.

3. The hand accessory of claim 1 wherein said plug has releasable joinable straps for releasably securing said plug to the hand.

4. The hand accessory of claim 1 wherein said outer surface and said curved front are notched and resilient to facilitate manipulation of said handle.

5. The hand accessory of claim 1 wherein said plug includes a removable metal insert.

6. The hand accessory of claim 1 wherein said plug is constructed of a flexible resilient plastic.

7. The hand accessory of claim 1, wherein said curved front of said vertical portion extends in substantially a straight line.

8. The hand accessory of claim 1 wherein said curved front of said vertical portion having an upper section and a lower section, said upper section being angularly disposed relative to said lower section.

9. A hand accessory to be used in conjunction with the handle of an implement, said hand accessory comprising a plug contoured to substantially completely cover and rest against the webbed portion of the hand between the base of thumb and the base of the forefinger and extend down into the palm of the hand, said plug being L-shaped in configuration defining an upper generally horizontal portion and a vertical portion, said upper generally horizontal portion extending over the webbed portion of the hand and having an outer surface which is curved to conform to the contour of the handle of the implement when grippingly held in the hand, said vertical portion having a rear surface curved to conform to the shape of the hand when gripping the handle, said upper generally horizontal portion being integral with the vertical portion, said vertical portion having a curved exterior surface to conform to the contour of the handle and an inner surface to rest against the palm of the hand, said plug being adapted to transmit muscular power during the swinging movement of the handle directly between the hand and the handle without substantial relative movement of the plug and the webbed portion of the hand.

10. In combination with the handle of the an implement where said handle is to be manually swung in motion by a hand of the human being and in combination with the human hand that has a palm and a webbed portion located between a thumb and forefinger, a hand accessory to be positioned between said handle and said hand, said hand accessory comprising:

a plug, said plug having a generally horizontal portion extending over and substantially covering and resting against said webbed portion;

a vertical portion integrally connected to said generally horizontal portion, said vertical portion resting against said palm, whereby said hand accessory functions to facilitate the transmission of manual swinging force between said hand and said handle.

11. The combination as defined in claim 10 wherein:

said generally horizontal portion and said vertical portion each having an exterior surface, said exterior surfaces being specially configured to conform to the contour of said handle.

12. The combination as defined in claim 11 wherein:

said special configuration including an established angular relationship.

* * * * *